US005588920A

United States Patent [19]

Soong

[11] Patent Number: 5,588,920

[45] Date of Patent: Dec. 31, 1996

[54] HANDLE OF GOLF CLUB WITH IMPROVED CONTROL

[76] Inventor: Tsai C. Soong, 1839 Jackson Rd., Penfield, N.Y. 14526

[21] Appl. No.: 560,113

[22] Filed: Nov. 17, 1995

Related U.S. Application Data

[63] Continuation-in-part of Ser. No. 503,311, Jul. 17, 1995, abandoned.

[51] Int. Cl.[6] ..... A63B 69/36

[52] U.S. Cl. ..... 473/231; 473/300; 473/318

[58] Field of Search ..... 473/201, 203, 473/204, 219, 223, 282, 300, 316, 318, 298, 314, 232, 231

[56] References Cited

U.S. PATENT DOCUMENTS

| | | |
|---|---|---|
| 1,212,038 | 1/1917 | Flaxman . |
| 2,124,534 | 7/1938 | Barnhart . |
| 2,133,696 | 10/1938 | Hall . |
| 3,638,943 | 2/1972 | Snauwaert . |
| 3,897,058 | 7/1975 | Koch . |
| 4,082,276 | 4/1978 | Szafianski . |
| 4,252,319 | 2/1981 | Lorang . |
| 4,736,949 | 4/1988 | Muroi . |
| 4,811,947 | 3/1989 | Takatsuka . |
| 4,979,743 | 12/1990 | Sears . |
| 5,054,781 | 10/1991 | Soong . |
| 5,131,652 | 7/1992 | Peng . |
| 5,143,373 | 9/1992 | Meissner . |
| 5,160,139 | 11/1992 | Soong . |
| 5,169,152 | 12/1992 | Marquardt . |
| 5,322,280 | 6/1994 | Wu ..... 273/81 R |
| 5,398,934 | 3/1995 | Soong . |

*Primary Examiner*—Sebastiano Passaniti
*Attorney, Agent, or Firm*—Bernard A. Chiama

[57] ABSTRACT

In a golf club an outer tube is installed between the soft grip and the shaft. The outer tube is a rigid, hollow tubular structure, which covers at least partially the handle portion of the shaft, the improvement comprising a provision of space for bending movement and structural support between the shaft and the outer tube such that when the shaft is bent during impact of the head with a golf ball, the outer tube does not interfere with the bending movement of the shaft.

15 Claims, 4 Drawing Sheets

HANDLE OF GOLF CLUB WITH IMPROVED CONTROL

This application is a continuation-in-part of application Ser. No. 08503,311, filed Jul. 17, 1995, now abandoned.

BACKGROUND OF THE INVENTION

The conventional golf club shaft is a tapered, hollow, steel or reinforced graphite shaft, slender towards the end which is fitted with a heavy head. Due to the fact that the shaft is slender and the head is heavy, the head may sway laterally during its movement in the air, that is, moving normal to the plane of the swinging of a club. Consequently it is difficult to control the trajectory of the head to hit the golf ball accurately. The present invention is to have a rigid outer tube, having a cutout in at least one side of the tube, covering the base shaft, supporting the base shaft at two end points in a "simply-supported" manner, or a cantilever type support at the butt end only, which improves the lateral stability and minimizes the trajectory error.

DESCRIPTIONS OF THE INVENTION AND PREFERRED EMBODIMENT

Figure 1:
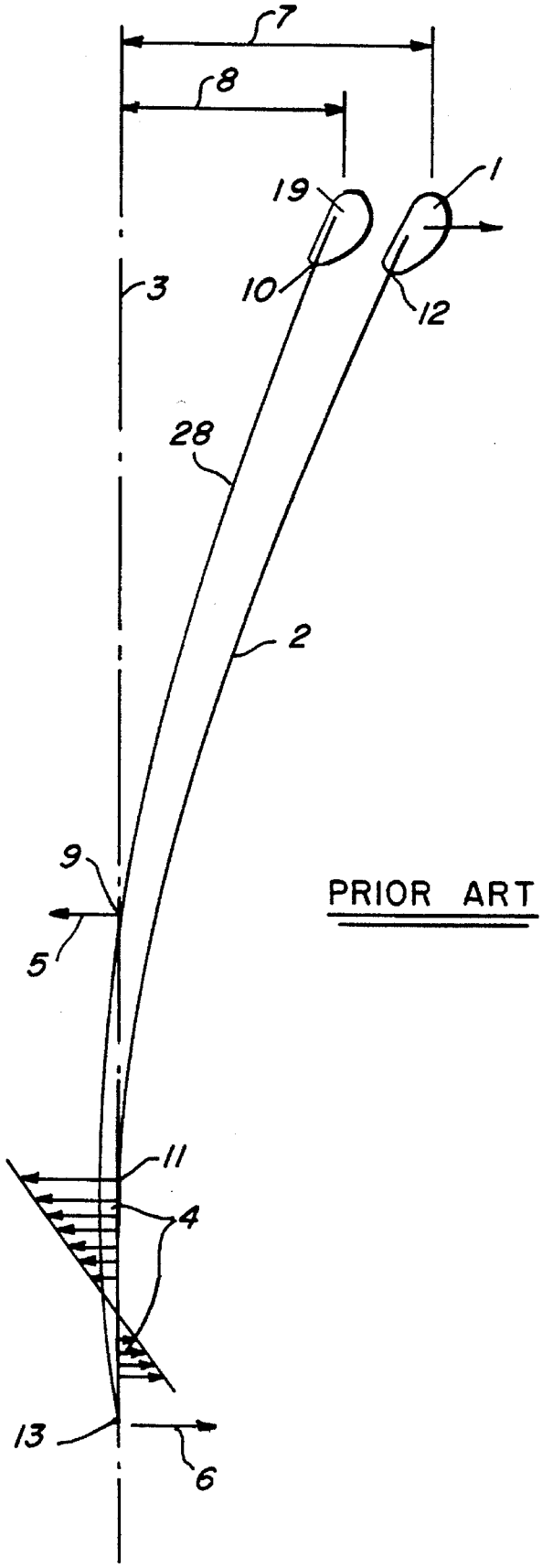
PRIOR ART FIG. 1
FIG. 1 shows the deflected shapes of the center lines of two golf clubs.

The shaft in a conventional golf club is a hollow round tubing, made of steel or reinforced graphite composite materials, tapered towards the end where it is fitted with a golf head. At the handle portion of the shaft, a soft grip, made of rubber or other cushioning material, is slipped over the handle portion for gripping by the player. In FIG. 1, a conventional golf club with a head 1 is being swung and the center line 2 of the shaft is shown as a curved line lying in the plane of swing formed by the curved center line 2 and the original straight axis line 3. The force applied by the player is a "distributed load" on the grip, which is a term used in mechanics to describe a variable, continuous pressure applied over the length of grip, shown in the sketch as two triangular distributed loads 4. This distributed load is equivalent to a resultant force equal to the inertia force from the head, plus a bending moment which balances the bending moment from the head. The cantilevered, free swing portion of the remaining length of the shaft is from point 11 to 12. The amount of head sway 7, is measured from the axis line 3 which is the extension of the straight line joining the end point 13 of the shaft and the end of the handle 11. This line is along the line the hand is holding the golf club when the golf club shaft straightens and the head hits the ball.

The present invention involves a new design wherein the player, instead of holding directly on to the handle, holds instead a rigid outer tube which covers the handle portion of the base shaft. In one version, this rigid outer tube joins the base shaft at two contact points, 13 and 9, in a "simply-supported" manner. The arrangement is such that the shaft can turn about the contact points and the handle portion bends partially inside the outer tube without interference. The contact forces in this case are two concentric forces 5 and 6. Due to the internal bend, the amount of sway 8, measured from the extension of 13 to 9, is reduced. "Simply-supported" is a term in mechanics defining the contact as transmitting concentric force only, no bending moment. In FIG. 1, the two shafts resist the same impact force 1 on the head by bending of the shaft accordingly. Comparing the sways of the head, 8 to 7, the new design has a shorter sway which indicates that the new design would have better control. This advantage would be more significant when a golf club is longer and its shaft is more flexible.

Figure 2:
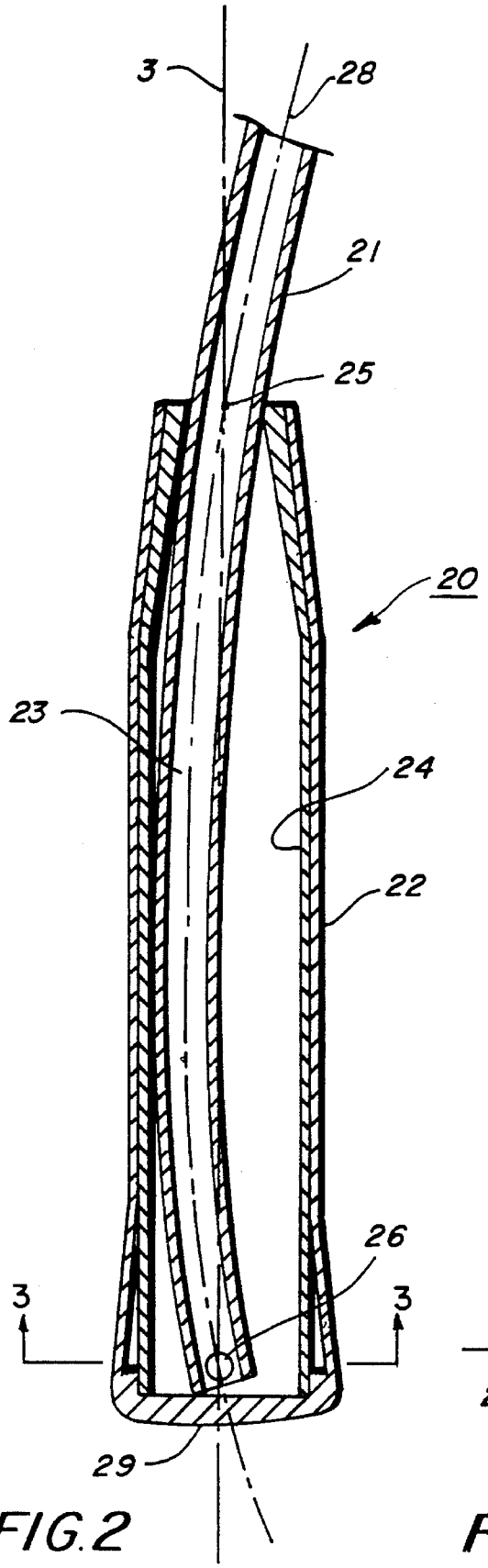
FIG. 2 shows a preferred embodiment where the deflected base shaft is contained inside an outer tube.
Figure 3:
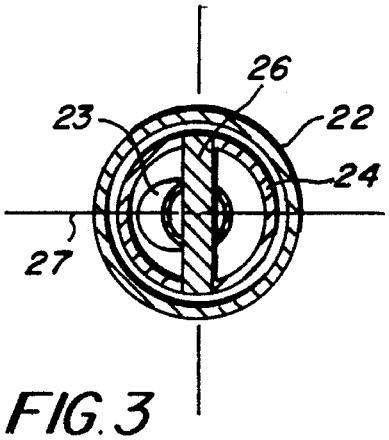
FIG. 3 shows a cross section taken along the line 2—2 of FIG. 2.

FIG. 2 is an embodiment which shows details of the handle portion 20 of the new club. The base shaft 23 joins the middle portion of the club shaft 21 at point 25. The handle portion 20 comprises the conventional soft grip 22 covering the outer tube 24 which covers the base shaft 23. The outer tube 24 is a rigid, hollow tubular structure, which encloses at least partially the smaller shaft 23 and transmits the driving forces to the base shaft 23 at two end points: joint 25 and the butt end 26. FIG. 3 is the cross section 3—3 of FIG. 2 which passes through a joining device 26 shown in the embodiment as a pin joint positioned adjacent to the butt end 29 of the base shaft. FIG. 3 shows a pin at 26 joining the base shaft 23 to the outer tube 24 in a simply supported manner with enough spacing left between 23 and 24 so that the base shaft can turns about the pin at the joint. The pin is a simply-supported joint which can prevent movements along the axis and perpendicular to the axis of the shaft, but can not prevent a rotation. A fixed end, or called clamped end, can prevent rotation as well as said translations. The axis of the pin is perpendicular to the plane of swing 27 of the club which contains the curved center line 28 of the shaft and the undisplaced straight axis line 3.

The conventional soft grip 22 may be made of an elastomeric material such as rubber which may completely or partially cover the outer tube for frictional and cosmetic purpose. In FIG. 2, the bending of the handle portion of the base shaft takes place inside the hollow space of the outer tube. Conceivably, the diameter of the outer tube has to be substantially greater than the diameter of the base shaft to accommodate the curved inner shaft. This is a point of disadvantage because a golfer does not like a grip which is too large in diameter.

Figure 7:
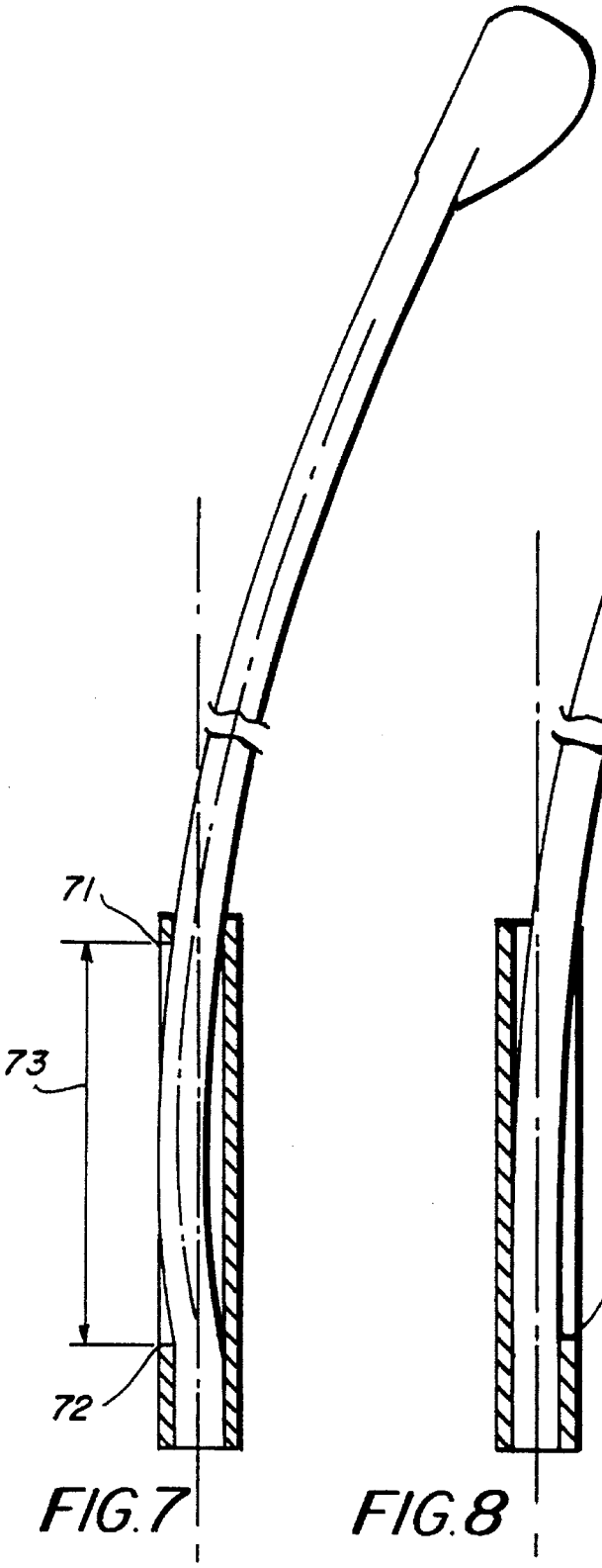
FIG. 7 shows a modified FIG. 4 embodiment where the butt end of the outer tube is joined to the shaft in a fixed-support manner.

The butt end joint at 26 in FIG. 2 embodiment may be a fixed end such as the end 71 in FIG. 7, instead of a simply-supported joint which reduces the amount of bending of the shaft inside the outer tube.

Figure 4:
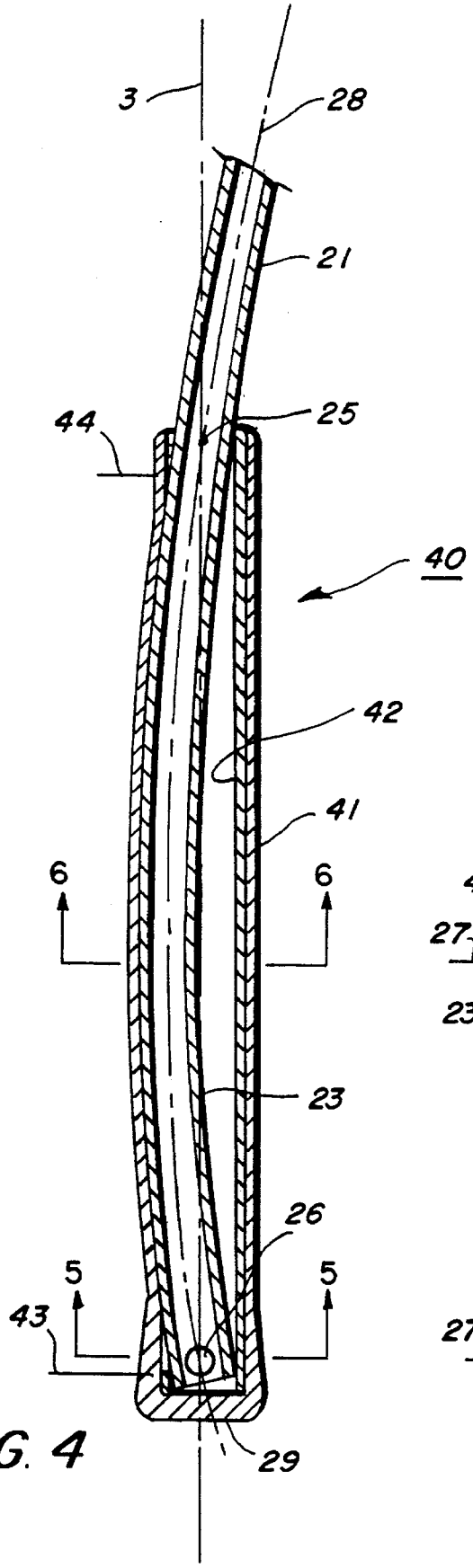
FIG. 4 shows another embodiment where the deflected base shaft is partially outside the outer tube through a surface cutout at the outer tube.
Figure 6:
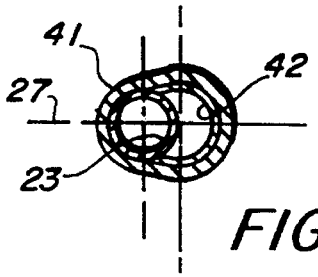
FIG. 6 shows the cross section taken along the line 6—6 of FIG. 4.
Figure 5:
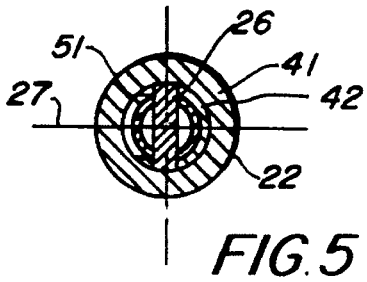
FIG. 5 shows the cross section taken along the line 5—5 of FIG. 4.

FIGS. 4, 5 and 6 illustrate a more preferred embodiment 40 in which the base shaft 23 and the soft grip 41 are similar as in FIG. 2, but the outer tube is smaller in diameter and, most importantly, there is at least one long, rectangular cutout at one side. The cutout is symmetric to the plane of swing, 27, of the bended shaft. FIG. 4 shows a cross section along the plane of bending of the base shaft. The length of the cutout is from 43 to 44. FIG. 5 shows section 5—5 in FIG. 4. The width 51 is symmetric to plane 27. The outer tube 42 is rigid, remaining substantially straight holding the base shaft 23 at joints 25 and 26, in the simply-supported manner. The criteria of the cutout size and location is that without the removal of the material on the wall, interference of bending will occur. It is to be noted that with joining points 25 and 29 along a straight line, and the edges of the cutout a distance away from it, the supporting contact force derived from the edges will prevent the bended shaft to have out-of-plane displacement. This improves control significantly. The soft grip covers the cutout and expands with the bulged out base shaft. FIG. 6, a section at 6—6 of FIG. 4, shows the displaced base shaft and the expanded soft grip. Other sides of the outer tube may have similar cutouts, but since the golf club swings only along one direction, other cutouts seem to serve no useful purpose. Cushion material may fill some of the space inside the outer tube.

FIG. 7 shows another embodiment wherein the joint 71 is a simply-supported joint, but the butt end joint 72 is a fixed end joint where the shaft is fixed to the tube against rotation. The cutout length is 73. Bending deflection of the base shaft will be reduced due to the different end condition at the butt end.

Figure 8:
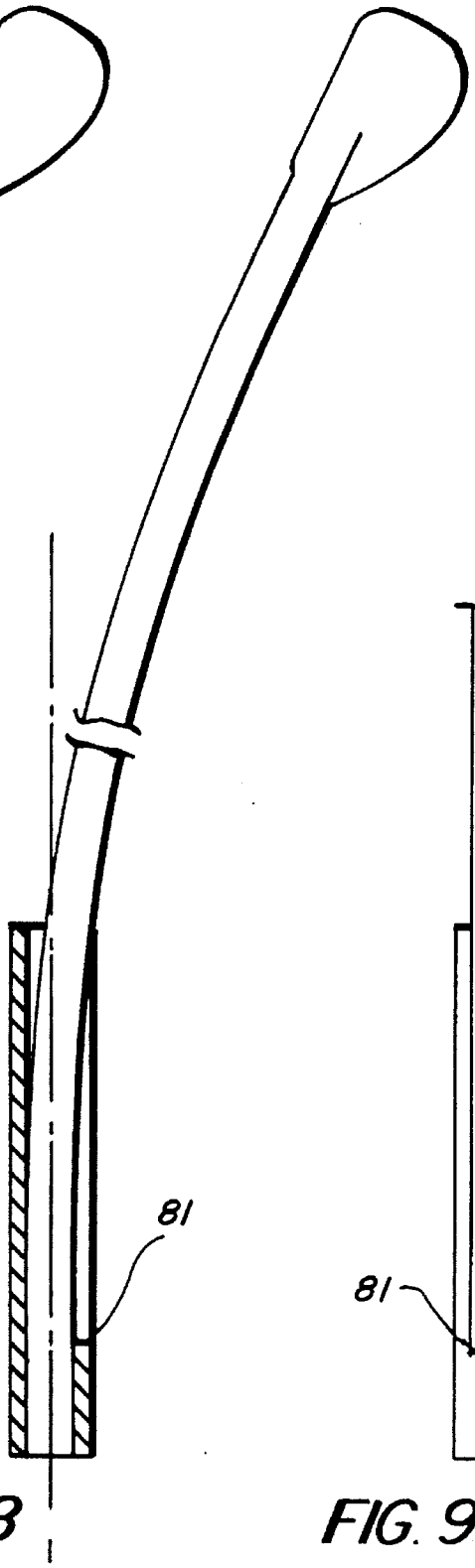
FIG. 8 shows another embodiment where the butt end of the outer tube is fixed to the base shaft and there is no support at the head end.
Figure 9:
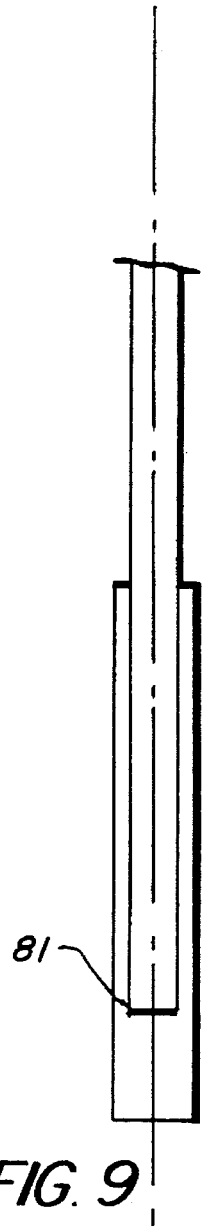
FIG. 9 is the side view of FIG. 8.

FIG. 8 shows the base shaft is fixed to the outer tube at the butt end 81 only. In this case, the cutout is moved to the opposite side of the outer tube and the cutout is open at the head end as shown in FIG. 9 which is the side view of FIG. 8. The soft grip is not shown in FIGS. 7 and 8.

The base shaft inside the outer tube may be of any cross sectional shape, constant or tapered, so as to make the shaft less or more difficult to bend along a specific bending direction, having more or less control. But in general, the constant diameter handle part of a conventional golf club shaft would be used the most often.

It should be pointed out that for practical considerations, the outer tube to be fitted to a conventional golf club should have a length not less than about 24 cm and not more than about 50% of the length of the golf club.

A handle assembly comprising at least the outer tube, covered by a soft grip, adapted to be joined to the base shaft of a golf club, with or without the head, could be a stand-alone shelf item. Such a handle assembly may be outfitted to be able to be detached and refitted to a golf club repeatedly.

Finally, minor changes in details of the invention which fall within the principles of the invention is deemed as within the scope of the appended claims.

What is claimed is:

1. A golf club having a handle portion, a shaft middle portion and a golf head, the shaft middle portion connecting the handle portion to the golf head adapted for striking a golf ball, the handle portion having at least a rigid outer tube covering at least partially a base shaft, said base shaft having two ends, a head end joining the base shaft to the shaft middle portion and a butt end which is close to a butt of the golf club, the improvement wherein said outer tube being at least partially hollow, having at least an elongated, approximate rectangular, symmetric cutout at one side of its outer wall, parallel to the longitudinal axis of the outer tube, said symmetric cutout having a length and width and being positioned such that when the golf club hits the golf ball and the impact force causes the base shaft to bend inside the outer tube, the displaced, curved part of the base shaft can slide freely in and out of the outer tube as is required during impact, without interference from the outer tube.

2. The golf club as defined in claim 1 wherein said length and width of said cutout of the outer tube is such that the edges of the cutout along its longitudinal axis provide physical guidance to constrain the base shaft from any movement perpendicular to the plane containing the center line of said cutout and the longitudinal axis of the undeformed base shaft, so that the base shaft can bend freely in said plane during impact of the head but can not deform out of said plane.

3. The golf club as defined in claim 2 wherein the outer tube is connected to the base shaft at two joint locations: a simply-supported joint at the head end and a simply-supported joint at the butt end.

4. The golf club as defined in claim 2 wherein the outer tube is connected to the base shaft at two joint locations: a simply-supported joint at the head end and a fixed joint at the butt end.

5. The golf club as defined in claim 2 wherein the outer tube is connected to the base shaft at one joint location: a fixed joint at the butt end.

6. The golf club as defined in claim 1 wherein the handle portion further includes a soft grip covering approximately the whole length of the outer tube.

7. The golf club as defined in claim 1 wherein the minimum length of the handle portion is approximately 24 cm.

8. The golf club as defined in claim 1 wherein the maximum length of the handle portion is approximately not more than 50 percent of the total length of the golf club.

9. The golf club as defined in claim 1 wherein the diameter of the outer tube is approximately unchanged along its length.

10. The golf club as defined in claim 1 wherein the outer tube is made of steel or reinforced fiber composite material.

11. The golf club as defined in claim 1 wherein the cross section of the outer tube is circular.

12. A golf club handle assembly having an outer tube and a soft grip covering the same wherein the outer tube is adapted to cover at least partially the base shaft of a golf club, with the base shaft having two ends, a head end joining the base shaft to the shaft middle portion of said golf club and a butt end opposite to the head end, the improvement wherein the outer tube is at least partially hollow, being formed with at least an elongated, approximate rectangular, symmetric cutout at one side of its outer wall, parallel to the longitudinal axis of the outer tube, said symmetric cutout having a length and width and being positioned such that when the golf club hits the golf ball and the impact force causes the base shaft to bend inside the outer tube, the displaced, curved part of the base shaft can slide freely in and out of the outer tube as is required during impact, without interference from the outer tube.

13. The golf club handle assembly as defined in claim 12 wherein the outer tube is arranged for adaptation to the base shaft at two joint locations: a simply-supported joint at the head end and a simply-supported joint at the butt end.

14. The golf club handle assembly as defined in claim 12 wherein the outer tube is designed to adapt to the base shaft at two joint locations: a simply-supported joint at the head end and a fixed joint at the butt end.

15. The golf club handle assembly as defined in claim 12 wherein the outer tube is designed to adapt to the base shaft at one joint location: a fixed joint at the butt end.

* * * * *